US011075451B2

(12) United States Patent
Ha et al.

(10) Patent No.: US 11,075,451 B2
(45) Date of Patent: Jul. 27, 2021

(54) ANTENNA DEVICE AND ELECTRONIC DEVICE INCLUDING SAME

(71) Applicant: Samsung Electronics Co., Ltd., Gyeonggi-do (KR)

(72) Inventors: Dohyuk Ha, Gyeonggi-do (KR); Junsig Kum, Gyeonggi-do (KR); Jungyub Lee, Gyeonggi-do (KR); Youngju Lee, Seoul (KR)

(73) Assignee: Samsung Electronics Co., Ltd.

( * ) Notice: Subject to any disclaimer, the term of this patent is extended or adjusted under 35 U.S.C. 154(b) by 0 days.

(21) Appl. No.: 16/462,054

(22) PCT Filed: Nov. 20, 2017

(86) PCT No.: PCT/KR2017/013179

§ 371 (c)(1),
(2) Date: May 17, 2019

(87) PCT Pub. No.: WO2018/097556

PCT Pub. Date: May 31, 2018

(65) Prior Publication Data

US 2019/0334232 A1 Oct. 31, 2019

(30) Foreign Application Priority Data

Nov. 23, 2016 (KR) ..... 10-2016-0156609

(51) Int. Cl.
*H01Q 1/42* (2006.01)
*H01Q 1/22* (2006.01)
(Continued)

(52) U.S. Cl.
CPC ..... *H01Q 1/42* (2013.01); *H01Q 1/2283* (2013.01); *H01Q 1/528* (2013.01)

(58) Field of Classification Search
CPC ..... H01Q 1/243; H01Q 21/28; H01Q 1/42; H01Q 1/2258; H01Q 9/42; H01Q 1/2266;
(Continued)

(56) References Cited

U.S. PATENT DOCUMENTS

2007/0216587 A1 9/2007 Schmidt et al.
2007/0257853 A1 11/2007 Gevorgian et al.
(Continued)

FOREIGN PATENT DOCUMENTS

CN 1914766 2/2007
CN 103036636 4/2013
(Continued)

OTHER PUBLICATIONS

Author: Mizumura Shin; Title: Array Antenna (2006) Publisher: Nov. 5, 2006 (JP2006121406) (Year: 2006).*
(Continued)

*Primary Examiner* — Wei (Victor) Y Chan
(74) *Attorney, Agent, or Firm* — The Farrell Law Firm, P.C.

(57) ABSTRACT

An antenna device can include: an antenna substrate, on which an array antenna including at least one radiation element is arranged; and a cover spaced apart from the antenna substrate at at least a predetermined distance and further including at least one relay radiation element arranged to correspond to the at least one radiation element.

15 Claims, 19 Drawing Sheets

(51) Int. Cl.
*H01Q 1/52* (2006.01)
*H01Q 21/28* (2006.01)
*H01Q 9/42* (2006.01)

(58) Field of Classification Search
CPC ..... H01Q 1/241; H01Q 1/242; H01Q 1/38; H01Q 21/0087; H01Q 1/273
USPC ..... 343/702, 700 MS, 767
See application file for complete search history.

(56) References Cited

U.S. PATENT DOCUMENTS

| | | | | |
|---|---|---|---|---|
| 2010/0039346 | A1 | 2/2010 | Peter et al. | |
| 2010/0309089 | A1 | 12/2010 | Collinson et al. | |
| 2013/0082767 | A1 | 4/2013 | Boers et al. | |
| 2014/0009355 | A1* | 1/2014 | Samardzija ..... | H01Q 13/16 343/789 |
| 2014/0285385 | A1* | 9/2014 | Aoki ..... | H01Q 5/378 343/702 |
| 2015/0171508 | A1 | 6/2015 | Jeon et al. | |
| 2015/0381229 | A1 | 12/2015 | Tzanidis et al. | |
| 2016/0118713 | A1 | 4/2016 | Hong et al. | |
| 2017/0155185 | A1 | 6/2017 | Hong et al. | |
| 2017/0309991 | A1* | 10/2017 | Noori ..... | H01Q 1/241 |
| 2018/0054006 | A1* | 2/2018 | Wang ..... | H01Q 21/24 |
| 2020/0091595 | A1* | 3/2020 | Lee ..... | H01Q 5/321 |

FOREIGN PATENT DOCUMENTS

| | | |
|---|---|---|
| CN | 104038583 | 9/2014 |
| JP | 2000-138525 | 5/2000 |
| JP | 3683422 | 8/2005 |
| JP | 2006121406 | 5/2006 |
| JP | 2010-204020 | 9/2010 |
| JP | 2012-235351 | 11/2012 |
| KR | 1020150069795 | 6/2015 |
| KR | 1020150134948 | 12/2015 |
| KR | 1020160004720 | 1/2016 |
| KR | 1020160047234 | 5/2016 |
| WO | WO 2005/043675 | 5/2005 |

OTHER PUBLICATIONS

Author: Mizumura Shin; Title: Array Antenna (2006) Publisher: Nov. 5, 2006 (JP2006121406) [Translation] (Year: 2006).*

European Search Report dated Sep. 27, 2019 issued in counterpart application No. 17874039.5-1205, 9 pages.

PCT/ISA/210 Search Report issued on PCT/KR2017/013179, pp. 5.

PCT/ISA/237 Written Opinion issued on PCT/KR2017/013179, pp. 5.

Chinese Office Action dated Jun. 28, 2020 issued in counterpart application No. 201780072521.X, 21 pages.

Chinese Office Action dated Feb. 19, 2021 issued in counterpart application No. 201780072521.X, 23 pages.

* cited by examiner

ANTENNA DEVICE AND ELECTRONIC DEVICE INCLUDING SAME

PRIORITY

This application is a National Phase Entry of PCT International Application No. PCT/KR2017/013179 which was filed on Nov. 20, 2017, and claims priority to Korean Patent Application No. 10-2016-0156609, which was filed on Nov. 23, 2016, the content of each of which is incorporated herein by reference.

TECHNICAL FIELD

Various embodiments of the present invention relate to an antenna device constituting a portion of a housing of an electronic device and an electronic device including the same.

BACKGROUND ART

With the widespread distribution of mobile electronic devices and commercialization of internet of things (IoT) technology, demand for wireless communication has increased; thus, more advanced mobile communication technology has is being studied. Nowadays, research is being performed actively on fifth generation (5G) wireless communication; and, in 5G wireless communication, in order to increase a data transfer rate, research is being performed to use a frequency band higher than that used in conventional wireless communication such as an mmWave band. The use of a high frequency band in this way provides an advantage in terms of transfer rate, but propagation attenuation is worse; therefore, studies have been undertaken for a method to prevent radio wave loss with long distance transmission.

An antenna of a base station to be used for wireless communication is generally disposed outdoors in consideration of wide coverage and path loss, but customer premises equipment (hereinafter, CPE) that receives radio waves from the antenna of the base station may be disposed indoors in consideration of management aspects. Radio waves may be transferred to indoors or may be transferred to outdoors through the CPE.

In order to protect the antenna device from the outside, the CPE, the base station, and an electronic device including a mobile phone protect the antenna device with an exterior material such as a cover (e.g., radome).

DISCLOSURE OF INVENTION

Technical Problem

Radio waves radiated from an antenna disposed inside the electronic device or radio waves received to the antenna should pass through an exterior material such as a cover, but there is a problem that a loss of radio waves occurs because of a thickness of the cover and a distance between the antenna and the cover.

An antenna device and an electronic device including the same according to various embodiments of the present invention include a structure that can improve antenna efficiency in a cover thereof.

Solution to Problem

In accordance with an aspect of the present invention, an electronic device, for example an antenna device, includes an antenna substrate in which an array antenna including at least one radiation element is disposed and a cover separated by a predetermined distance or more from the antenna substrate and including at least one repeating radiation element disposed to correspond to the at least one radiation element.

In accordance with another aspect of the present invention, an electronic device includes a display disposed at a front surface thereof; a cover disposed at a rear surface of the electronic device; a frame in which the front surface and the rear surface are separated from each other to form a space and that encloses the space; an antenna device configured to transmit and receive radio waves, wherein the antenna device includes an antenna substrate disposed within the electronic device and in which an array antenna including at least one radiation element is disposed; and at least one repeating radiation element separated by a predetermined distance or more from the antenna substrate and disposed to correspond to the at least one radiation element on the cover.

Advantageous Effects of Invention

An antenna device and an electronic device including the same according to various embodiments of the present invention can include a resonance structure capable of preventing attenuation of radio waves and can include a structure that can separate a radiation unit of each of a plurality of antennas to improve radio wave transmission efficiency and bandwidth.

MODE FOR THE INVENTION

Figure 1:
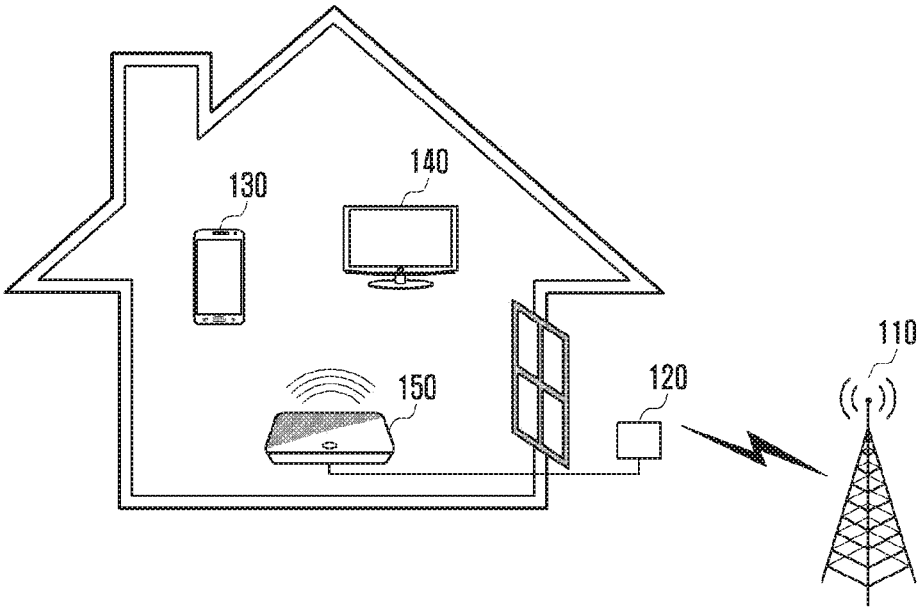
FIG. 1 is a diagram illustrating an electronic device and an antenna device of a base station, CPE, router, mobile terminal, and television.

Hereinafter, various embodiments of this document will be described with reference to the accompanying drawings. It should be understood that embodiments and terms used in the embodiments do not limit any technology described in this document to a specific embodiment and include various changes, equivalents, and/or replacements of a corresponding embodiment. The same reference numbers are used throughout the drawings to refer to the same or like parts. Unless the context otherwise clearly indicates, words used in the singular include the plural, and the plural includes the singular. In this document, an expression such as "A or B" and "at least one of A or/and B" may include all possible combinations of the together listed items. An expression such as "first" and "second" used in this document may indicate corresponding constituent elements regardless of order and/or importance, and such an expression is used for distinguishing a constituent element from another constituent element and does not limit any corresponding constituent elements. When it is described that a constituent element (e.g., first constituent element) is "(functionally or communicatively) coupled to" or is "connected to" another constituent element (e.g., second constituent element), the constituent element may be directly connected to the other constituent element or may be connected to the other constituent element through another constituent element (e.g., third constituent element).

In this document, "configured to (or set to)" may be interchangeably used in hardware and software with, for example, "appropriate to", "having a capability to", "changed to", "made to", "capable of", or "designed to" according to a situation. In any situation, an expression "device configured to" may mean that the device is "capable of" being configured together with another device or component. For example, a "processor configured to (or set to) perform phrases A, B, and C" may mean an exclusive processor (e.g., embedded processor) for performing a corresponding operation or a generic-purpose processor (e.g., CPU or application processor) that can perform a corresponding operation by executing at least one software program stored at a memory device.

An electronic device according to various embodiments of this document may include at least one of, for example, a smart phone, tablet personal computer (PC), mobile phone, video phone, electronic book reader, desktop PC, laptop PC, netbook computer, workstation, server, personal digital assistant (PDA), portable multimedia player (PMP), MP3 player, medical device, camera, or wearable device. The wearable device may include at least one of an accessory type device (e.g., watch, ring, bracelet, ankle bracelet, necklace, glasses, contact lens), head-supported-device (HMD), textile or clothing integral type device (e.g., electronic clothing), body attachment type device (e.g., skin pad or tattoo), or bio implantable circuit. In an embodiment, the electronic device may include at least one of, for example, a television, digital video disk (DVD) player, audio device, refrigerator, air-conditioner, cleaner, oven, microwave oven, washing machine, air cleaner, set-top box, home automation control panel, security control panel, media box (e.g., Samsung HomeSync™, AppleTV™, or Google TV™), game console (e.g., Xbox™, PlayStation™), electronic dictionary, electronic key, camcorder, or electronic frame.

In another embodiment, the electronic device may include at least one of various medical devices (e.g., various portable medical measurement devices (blood sugar measurement device, heartbeat measurement device, blood pressure measurement device, or body temperature measurement device), magnetic resonance angiography (MRA) device, magnetic resonance imaging (MRI) device, computed tomography (CT) device, scanning machine, and ultrasonic wave device), navigation device, global navigation satellite system (GNSS), event data recorder (EDR), flight data recorder (FDR), vehicle infotainment device, ship electronic equipment (e.g., ship navigation device, gyro compass), avionics, security device, vehicle head unit, industrial or home robot, drone, automated teller machine (ATM) of a financial institution, point of sales (POS) of a store, or Internet of things device (e.g., bulb, various sensors, sprinkler, fire alarm, thermostat, street light, toaster, exercise device, hot water tank, heater, boiler). According to an embodiment, the electronic device may include at least one of furniture, a portion of a building/structure or a vehicle, electronic board, electronic signature receiving device, projector, or various measurement devices (e.g., water supply, electricity, gas, or electric wave measurement device). In various embodiments, the electronic device may be flexible or may be two or more combinations of the foregoing various devices. An electronic device according to an embodiment of this document is not limited to the foregoing devices. In this document, a term "user" may indicate a person using an electronic device or a device (e.g., artificial intelligence electronic device) using an electronic device.

FIG. 1 is a diagram illustrating an electronic device and an antenna device of a base station, customer premises equipment (hereinafter, CPE), router, mobile terminal, and television (TV).

A base station 110 outputs radio waves through an antenna, and radio waves output from the antenna of the base station 110 may be transmitted to a CPE 120. Alternatively, the base station 110 may receive radio waves output by the CPE 120.

The CPE 120 is a terminal device connected to the network and may include a mobile terminal 130, TV 140, and router 150. The CPE 120 may be provided indoors and, in particular, the CPE 120 may be disposed in the vicinity of a window.

A wireless communication frequency band of the base station 110, the CPE 120, the mobile terminal 130, the TV 140, and the router 150 may be an ultrahigh frequency (e.g., 28 GHz) band. As is known, in the case of using a high frequency band in an ultrahigh frequency band, there is an advantage in a transmission rate, but propagation attenuation may be worse.

An electronic device and an antenna device of the base station 110, the CPE 120, the mobile terminal 130, the TV 140, and the router 150 may include an outer shape or appearance such as a case, a cover, and a radome in order to protect the inside thereof.

Therefore, radio waves radiated from the antenna device and an antenna included in the electronic device or radio waves received to the antenna should pass through an outer shape or appearance such as the case, the cover, and the radome. Radio waves may be attenuated when passing through the outer shape or appearance such as the case, the cover, and the radome.

An antenna device and an electronic device according to various embodiments of the present invention may be an array antenna, and the array antenna may include at least two radiation elements.

The case, the cover, and the radome according to various embodiments of the present invention may include a separation structure that may separate each of radiation elements of the array antenna and/or a repeating radiation element capable of amplifying radio waves radiated from the radiation element.

Figure 2:
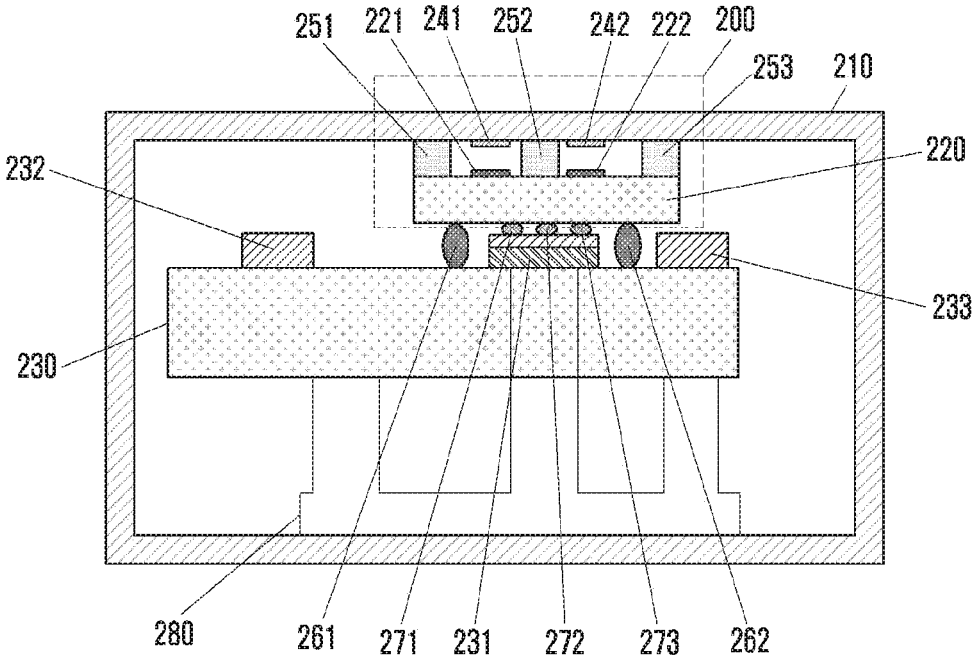
FIG. 2 is a diagram illustrating an antenna device according to various embodiments of the present invention.

FIG. 2 is a diagram illustrating an antenna device according to various embodiments of the present invention.

The antenna device may be a base station 110, CPE 120, or router 150.

The antenna device may include an antenna unit 200, cover 210, antenna substrate 220, main board 230, and heat sink 280.

At least one component 231, 232, and 233 may be included on the main board 230. At least one component 231, 232, and 233 may be an integrated circuit (IC), a semiconductor chip, a radio frequency integrated circuit (RFIC) 231, and a processor 232 disposed on the main board 230. The processor 232 may control the RFIC 231 received from the RFIC 231 and control other electronic components according to reception sensitivity of radio waves.

The RFIC 231 includes at least one connection means (e.g., ball grid array (BGA)) 271, 272, and 273, and the RFIC 231 may be electrically connected to the antenna substrate 220 using the at least connection means 271, 272, and 273. The main board 230 may support the antenna substrate 220 and the antenna unit 200 through at least one support means 261 and 262.

The RFIC 231 may be disposed toward the main board 230 on the antenna substrate 220, and an array antenna including at least one radiation element 221 and 222 may be disposed toward the cover 210.

The cover 210 may include at least one repeating radiation element 241 and 242 disposed to correspond to the radiation elements 221 and 222 in at least a portion thereof. At least one radiation element 221 and 222 and at least one repeating radiation element 241 and 242 may be separated from each other by a predetermined distance or more. At least one repeating radiation element 241 and 242 may include a resonance structure to be electromagnetically coupled to at least one radiation element 221 and 222. At least one repeating radiation element 241 and 242 may form a resonance structure with at least one radiation element 221 and 222 to radiate radio waves to the outside of the cover 210 by reducing attenuation of radio waves radiated from at least one radiation element 221 and 222. Alternatively, at least one repeating radiation element 241 and 242 may transfer radio waves transferred from the outside through the cover 210 to at least one radiation element 221 and 222 through resonance. According to various embodiments of the present invention, the cover 210 may be a dielectric such as a plastic.

Each of the radiation elements 221 and 222 may be separated through at least one isolation wall 251, 252, and 253. By installing the isolation walls 251 and 252, the radiation elements 221 and 222 on the array antenna may increase directivity. The isolation walls 251, 252, and 253 may enable radio waves radiated through the radiation elements 221 and 222 to be radiated in an oriented direction instead of being dispersed. The isolation walls 251, 252, and 253 may be made of, for example, a material that may have a conductive property. According to various embodiments, the isolation walls 251, 252, and 253 may be, for example, a dielectric coated with a material that may have a conductive property.

The antenna unit 200 may include an antenna substrate 220 including at least one radiation element, a cover 210 separated by a predetermined distance or more from the antenna substrate 220, at least one radiation element 221 and 222 disposed toward the outside on the antenna substrate 220, repeating radiation elements 241 and 242 disposed to correspond to the radiation elements 221 and 222 in at least a portion of the cover 210, and at least one isolation wall 251, 252, and 253.

The at least one radiation element 221 and 222 and at least one respective repeating radiation element 241 and 242 may be disposed to face each other. For example, the first radiation element 221 may be disposed to face the first repeating radiation element 241 on the cover 1220.

At least one isolation wall 251, 252, and 253 may separate at least one respective radiation element 221 and 222 and separate at least one respective repeating radiation element 241 and 242. For example, the first radiation element 221 and the first repeating radiation element 241 may be disposed between the first isolation wall 251 and the second isolation wall 252, and the first radiation element 221 and the first repeating radiation element 241 may be separated from the other radiation element 222 and the other repeating radiation element 242 by the first isolation wall 251 and the second isolation wall 252. In another example, the second radiation element 222 and the second repeating radiation element 242 may be disposed between the second isolation wall 252 and the third isolation wall 253, and the second radiation element 222 and the second repeating radiation element 242 may be separated from the other radiation element 221 and the other repeating radiation element 241 by the second isolation wall 252 and the third isolation wall 253. A length of the at least one isolation wall 251, 252, and 253 may be the same as a separation distance between the cover 210 and the antenna substrate 220.

Figure 3:
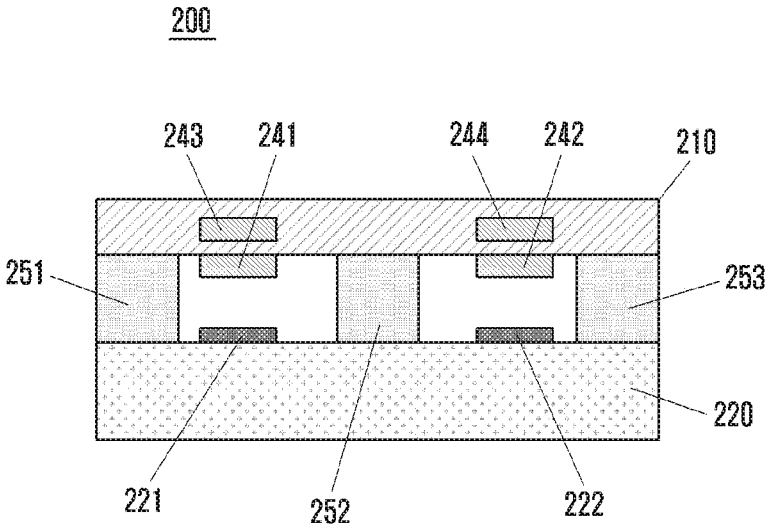
FIG. 3 is a diagram illustrating an antenna unit according to various embodiments of the present invention.

FIG. 3 is a diagram illustrating an antenna unit 200 according to various embodiments of the present invention.

The antenna unit 200 may include an antenna substrate 220 including at least one radiation element, a cover 210 separated by a predetermined distance or more from the antenna substrate 220, at least one radiation element 221 and 222 disposed toward the outside on the antenna substrate 220, repeating radiation elements 241 and 242 disposed to correspond to the radiation elements 221 and 222 in at least a portion of the cover 210, repeating radiation elements 243 and 244 disposed to correspond to the radiation elements 221 and 222 within the cover 210, and at least one isolation wall 251, 252, and 253.

Each of at least one radiation element 221 and 222, at least one repeating radiation element 241 and 242 disposed on the cover 210, and at least one repeating radiation element 243 and 244 disposed within the cover 210 may be disposed to face each other. For example, the first radiation element 221 may be disposed to face the first repeating radiation element 241 on the cover 210 and the third repeating radiation element 243 within the cover 210. The second radiation element 222 may be disposed to face the second repeating radiation element 242 on the cover 210 and the fourth repeating radiation element 244 within the cover 210.

At least one isolation wall 251, 252, and 253 may separate at least one respective radiation element 221 and 222 and separate at least one respective repeating radiation element 241 and 242. For example, the first radiation element 221 and the first repeating radiation element 241 may be disposed between the first isolation wall 251 and the second isolation wall 252, and the first radiation element 221 and the first repeating radiation element 241 may be separated from the other radiation element 222 and the other repeating radiation element 242 by the first isolation wall 251 and the second isolation wall 252. In another example, the second radiation element 222 and the second repeating radiation element 242 may be disposed between the second isolation wall 252 and the third isolation wall 253, and the second radiation element 222 and the second repeating radiation element 242 may be separated from the other radiation element 221 and the other repeating radiation element 241 by the second isolation wall 252 and the third isolation wall 253. A length of the at least one isolation wall 251, 252, and 253 may be the same as a separation distance between the cover 210 and the antenna substrate 220. The isolation walls 251, 252, and 253 may be made of, for example, a material that may have a conductive property. According to various embodiments, the isolation walls 251, 252, and 253 may be, for example, a dielectric coated with a material that may have a conductive property.

Figure 4:
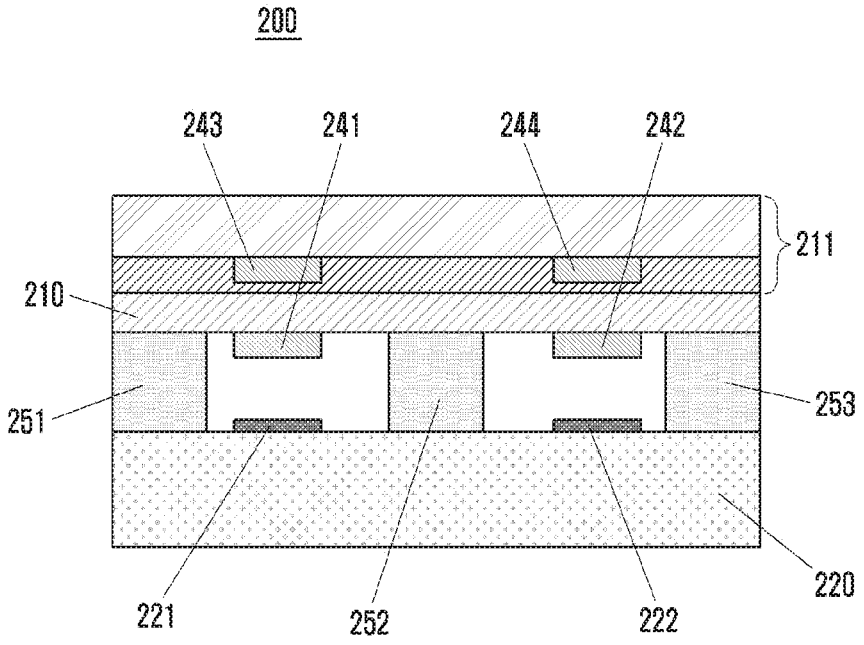
FIG. 4 is a diagram illustrating an antenna unit according to various embodiments of the present invention.

FIG. 4 is a diagram illustrating an antenna unit 200 according to various embodiments of the present invention.

The antenna unit 200 may include an antenna substrate 220 including at least one radiation element, a cover 210 separated by a predetermined distance or more from the antenna substrate 220, an additional cover 211 that covers the cover 210, at least one radiation element 221 and 222 disposed toward the outside on the antenna substrate 220, repeating radiation elements 241 and 242 disposed to correspond to the radiation elements 221 and 222 in at least a portion of the cover 210, repeating radiation elements 243 and 244 disposed to correspond to the radiation elements 221 and 222 within the additional cover 211, and at least one isolation wall 251, 252, and 253. The additional cover 211 may be a dielectric of a material different from that of the cover 210. According to various embodiments, the additional cover 211 may be a dielectric of a material homogeneous to that of the cover 210.

Each of at least one radiation element 221 and 222, at least one repeating radiation element 241 and 242 disposed on the cover 210, and at least one repeating radiation element 243 and 244 disposed within the additional cover 211 may be disposed to face each other. For example, the first radiation element 221 may be disposed to face the first repeating radiation element 241 on the cover 210 and the third repeating radiation element 243 within the additional cover 211. The second radiation element 222 may be disposed to face the second repeating radiation element 242 on the cover 210 and the fourth repeating radiation element 244 within the additional cover 211.

At least one isolation wall 251, 252, and 253 may separate at least one respective radiation element 221 and 222 and separate at least one respective repeating radiation element 241 and 242. For example, the first radiation element 221 and the first repeating radiation element 241 may be disposed between the first isolation wall 251 and the second isolation wall 252, and the first radiation element 221 and the first repeating radiation element 241 may be separated from the other radiation element 222 and the other repeating radiation element 242 by the first isolation wall 251 and the second isolation wall 252. In another example, the second radiation element 222 and the second repeating radiation element 242 may be disposed between the second isolation wall 252 and the third isolation wall 253, and the second radiation element 222 and the second repeating radiation element 242 may be separated from the other radiation element 221 and the other repeating radiation element 241 by the second isolation wall 252 and the third isolation wall 253. A length of the at least one isolation wall 251, 252, and 253 may be the same as a separation distance between the cover 210 and the antenna substrate 220. The isolation walls 251, 252, and 253 may be made of, for example, a material that may have a conductive property. According to various embodiments, the isolation walls 251, 252, and 253 may be, for example, a dielectric coated with a material that may have a conductive property.

Figure 5:
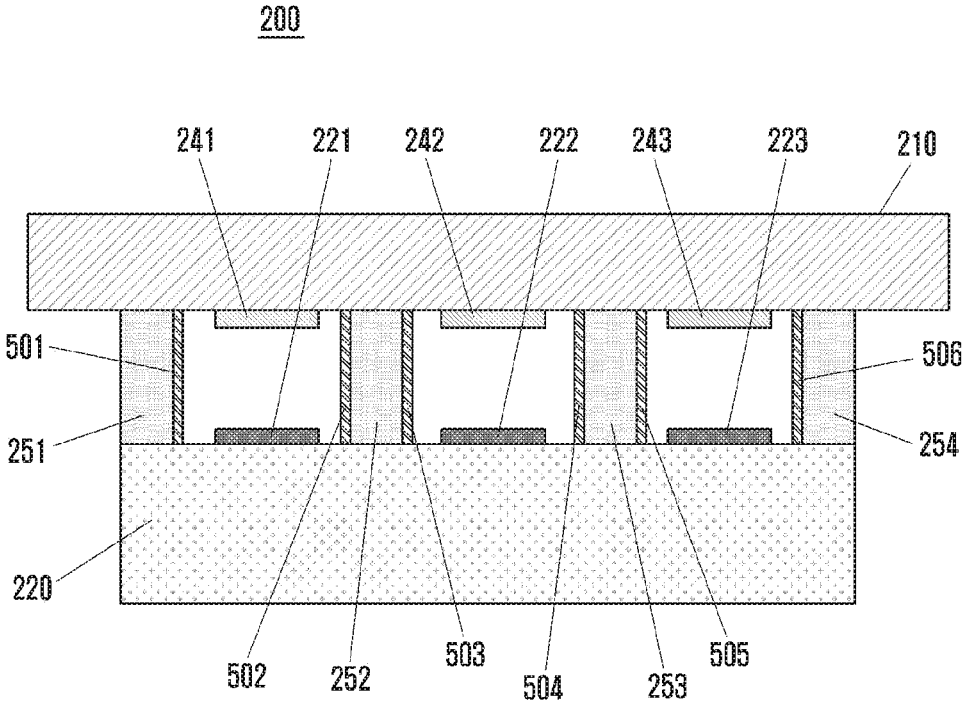
FIG. 5 is a diagram illustrating an antenna unit according to various embodiments of the present invention.

FIG. 5 is a diagram illustrating an antenna unit 200 according to various embodiments of the present invention.

The antenna unit 200 may include an antenna substrate 220 including at least one radiation element, a cover 210 separated by a predetermined distance or more from the antenna substrate 220, at least one radiation element 221, 222, and 223 disposed toward the outside on the antenna substrate 220, repeating radiation elements 241, 242, and 243 disposed to correspond to the radiation elements 221, 222, and 223 in at least a portion of the cover 210, and at least one isolation wall 251, 252, 253, and 254.

Each of the at least one radiation element 221, 222, and 223 and at least one repeating radiation element 241, 242, and 243 may be disposed to face each other. For example, the first radiation element 221 may be disposed to face the first repeating radiation element 241 on the cover 210.

At least one isolation wall 251, 252, 253, and 254 may separate at least one respective radiation element 221, 222, and 223 and separate at least one respective repeating radiation element 241, 242, and 243. For example, the first radiation element 221 and the first repeating radiation element 241 may be disposed between the first isolation wall 251 and the second isolation wall 252, and the first radiation element 221 and the first repeating radiation element 241 may be separated from the other radiation element 222 and the other repeating radiation element 242 by the first isolation wall 251 and the second isolation wall 252. In another example, the second radiation element 222 and the second repeating radiation element 242 may be disposed between the second isolation wall 252 and the third isolation wall 253, and the second radiation element 222 and the second repeating radiation element 242 may be separated from the other radiation element 221 and 223 and other repeating radiation elements 241 and 243 by the second isolation wall 252 and the third isolation wall 253. In another example, the third radiation element 223 and the third repeating radiation element 243 may be disposed between the third isolation wall 253 and the fourth isolation wall 254, and the third radiation element 223 and the third repeating radiation element 243 may be separated from other radiation elements 221 and 222 and other repeating radiation elements 241 and 242 by the third isolation wall 253 and the fourth isolation wall 254. A length of the at least one isolation wall 251, 252, 253, and 254 may be the same as a separation distance between the cover 210 and the antenna substrate 220. The isolation walls 251, 252, 253, and 254 may be, for example, a dielectric coated with materials 501, 502, 503, 504, 505, and 506 that may have a conductive property.

Figure 6:
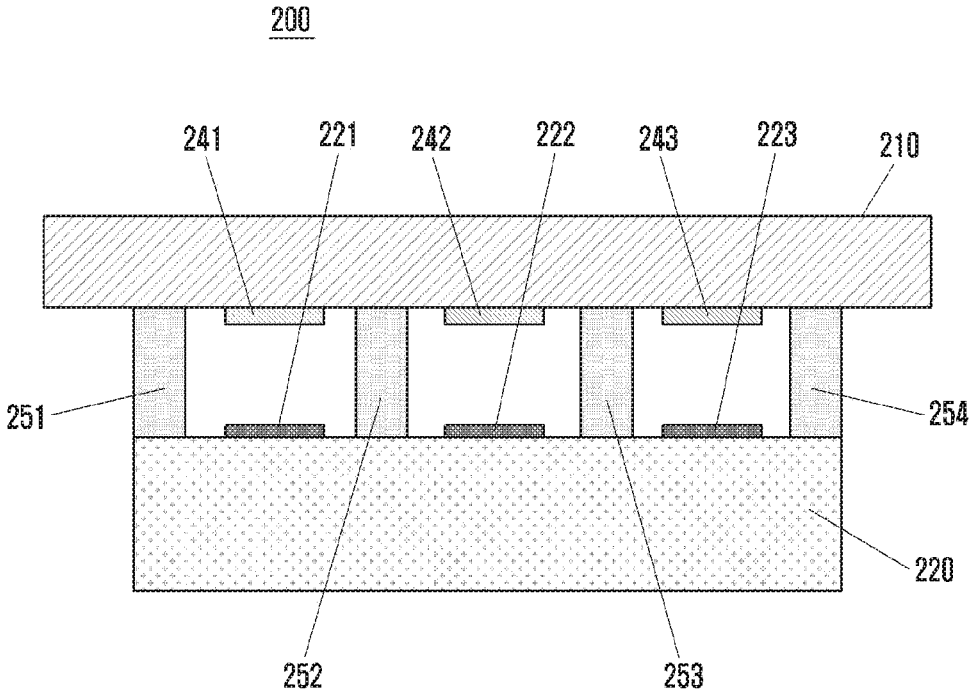
FIG. 6 is a diagram illustrating an antenna unit according to various embodiments of the present invention.

FIG. 6 is a diagram illustrating an antenna unit 200 according to various embodiments of the present invention.

The antenna unit 200 may include an antenna substrate 220 including at least one radiation element, a cover 210 separated by a predetermined distance or more from the antenna substrate 220, at least one radiation element 221, 222, and 223 disposed toward the outside on the antenna substrate 220, repeating radiation elements 241, 242 and 243 disposed to correspond to the radiation elements 221, 222, and 223 in at least a portion of the cover 210, and at least one isolation wall 251, 252, 253, and 254.

Each of the at least one radiation element 221, 222, and 223 and at least one repeating radiation element 241, 242, and 243 may be disposed to face each other. For example, the first radiation element 221 may be disposed to face the first repeating radiation element 241 on the cover 210.

At least one isolation wall 251, 252, 253, and 254 may separate at least one respective radiation element 221, 222, and 223 and separate at least one respective repeating radiation element 241, 242, and 243. For example, the first radiation element 221 and the first repeating radiation element 241 may be disposed between the first isolation wall 251 and the second isolation wall 252, and the first radiation element 221 and the first repeating radiation element 241 may be separated from the other radiation element 222 and the other repeating radiation element 242 by the first isolation wall 251 and the second isolation wall 252. In another example, the second radiation element 222 and the second repeating radiation element 242 may be disposed between the second isolation wall 252 and the third isolation wall 253, and the second radiation element 222 and the second repeating radiation element 242 may be separated from other radiation elements 221 and 223 and other repeating radiation elements 241 and 243 by the second isolation wall 252 and the third isolation wall 253. In another example, the third radiation element 223 and the third repeating radiation element 243 may be disposed between the third isolation wall 253 and the fourth isolation wall 254, and the third radiation element 223 and the third repeating radiation element 243 may be separated from other radiation elements 221 and 222 and other repeating radiation elements 241 and 242 by the third isolation wall 253 and the fourth isolation wall 254. A length of the at least one isolation wall 251, 252, 253, and 254 may be the same as a separation distance between the cover 210 and the antenna substrate 220. The isolation walls 251, 252, 253, and 254 may be made of, for example, a material that may have a conductive property.

Figure 7:
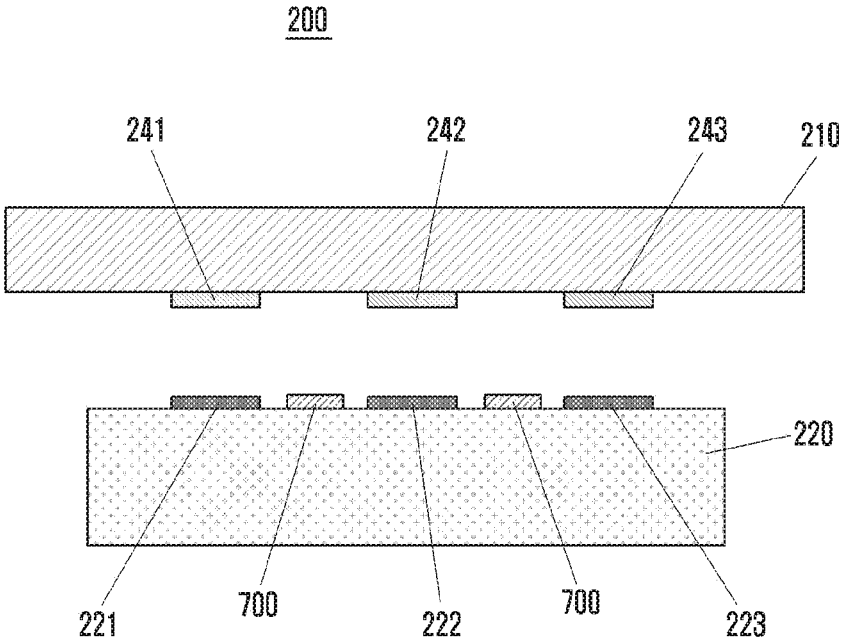
FIG. 7 is a diagram illustrating an antenna unit according to various embodiments of the present invention.

FIG. 7 is a diagram illustrating an antenna unit 200 according to various embodiments of the present invention.

The antenna unit 200 may include an antenna substrate 220 including at least one radiation element, a cover 210 separated by a predetermined distance or more from the antenna substrate 220, at least one radiation element 221, 222, and 223 disposed toward the outside on the antenna substrate 220, repeating radiation elements 241, 242 and 243 disposed to correspond to the radiation elements 221, 222, and 223 in at least a portion of the cover 210, and at least one conductive pattern 700 disposed on the antenna substrate 220 to electromagnetically separate the radiation elements 221, 222, and 223.

Each of the at least one radiation element 221, 222, and 223 and at least one repeating radiation element 241, 242, and 243 may be disposed to face each other. For example, the first radiation element 221 may be disposed to face the first repeating radiation element 241 on the cover 210.

At least one conductive pattern 700 may separate each of at least one radiation element 221, 222, and 223. For example, the conductive pattern 700 may be disposed between the first radiation element 221 and the second radiation element 222, and the conductive pattern 700 may be disposed between the second radiation element 222 and the third radiation element 223.

Figure 8:
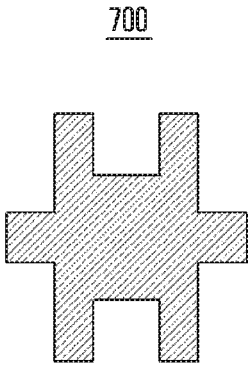
FIG. 8 is a diagram illustrating a conductive pattern according to various embodiments of the present invention.

FIG. 8 is a diagram illustrating a conductive pattern 700 according to various embodiments of the present invention.

The conductive pattern 700 may have a modified H-shaped form. The conductive pattern 700 may have a form in which a cross stroke laterally crosses a vertical stroke in a form/shape of a capital letter H. In various embodiments, the conductive pattern 700 may have a form in which two crosses are coupled in parallel.

Figure 9:
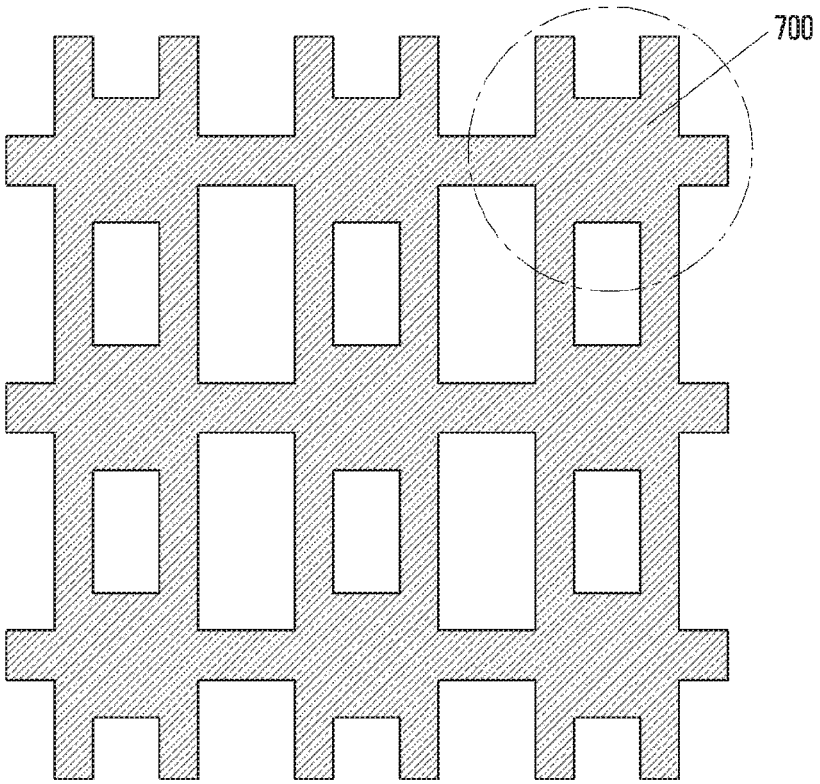
FIG. 9 is a diagram illustrating a coupled pattern of conductive patterns according to various embodiments of the present invention.

FIG. 9 is a diagram illustrating a coupled pattern of conductive patterns 700 according to various embodiments of the present invention.

In FIG. 9, conductive patterns 700 of a modified H-shaped form are coupled to form a net pattern; and, in each empty space, each of radiation elements 221, 222, and 223 of FIG. 7 may be disposed.

Figure 10:
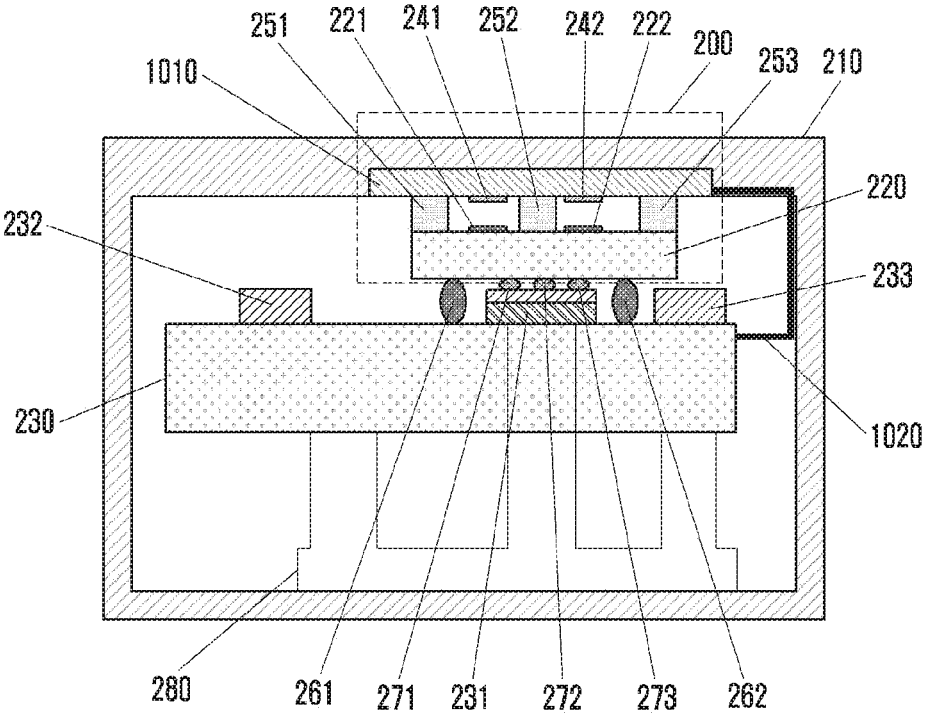
FIG. 10 is a diagram illustrating an antenna device according to various embodiments of the present invention.

FIG. 10 is a diagram illustrating an antenna device according to various embodiments of the present invention.

The antenna device may be a base station 110, CPE 120, or router 150.

The antenna device may include an antenna unit 200, cover 210, antenna substrate 220, main board 230, and heat sink 280.

At least one component 231, 232, and 233 may be included on the main board 230. At least one component 231, 232, and 233 may be an integrated circuit (IC), a semiconductor chip, a radio frequency integrated circuit (RFIC) 231, and a processor 232 disposed on the main board 230. The processor 232 may control the RFIC 231 received from the RFIC 231 and control other electronic components according to reception sensitivity of radio waves.

The RFIC 231 may include at least one connection means (e.g., ball grid array (BGA)) 271, 272, and 273, and the RFIC 231 may be electrically connected to the antenna substrate 220 using the at least connection means 271, 272, and 273. The main board 230 may support the antenna substrate 220 and the antenna unit 200 through at least one support means 261 and 262.

The RFIC 231 may be disposed toward the main board 230 on the antenna substrate 220, and an array antenna including at least one radiation element 221 and 222 may be disposed toward the cover 1220.

The cover 210 may include at least one repeating radiation element 241 and 242 disposed to correspond to the radiation elements 221 and 222 in at least a portion thereof. At least one radiation element 221 and 222 and at least one repeating radiation element 241 and 242 may be separated by a predetermined distance or more. At least one repeating radiation element 241 and 242 may include a resonance structure to be electromagnetically coupled to at least one radiation element 221 and 222. At least one repeating radiation element 241 and 242 reduces attenuation of radio waves radiated from the at least one radiation element 221 and 222 by forming a resonance structure with the at least one radiation element 221 and 222 to radiate radio waves to the outside of the cover 210. Alternatively, at least one repeating radiation element 241 and 242 may transfer radio waves transferred from the outside through the cover 210 to the at least one radiation element 221 and 222 through resonance. According to various embodiments of the present invention, the cover 210 may be a dielectric such as a plastic.

In at least a portion of the cover 210, a ferroelectric 1010 may be disposed. The ferroelectric 1010 disposed in a portion of the cover 210 may be disposed at the antenna unit 200, and the repeating radiation elements 241 and 242 may be disposed on the ferroelectric 1010. The ferroelectric 1010 may be electrically connected to the main board 230 using a conductor 1020, and a dielectric constant may be changed under the control of the main board 230. The main board 230 may transfer an electrical stimulation to the ferroelectric 1010 through the conductor 1020; and the ferroelectric 1010, having received the electrical stimulation, may change a direction of polarization to change the dielectric constant. For example, the ferroelectric 1010 may be at least one of BaTiO3, SrTiO3, or LiNbO3. The processor 232 included in the main board 230 may determine reception sensitivity or radiation sensitivity of radio waves to transfer an electrical signal that may change a dielectric constant of the ferroelectric 1010 to the ferroelectric 1010 through the conductor 1020.

Each of the radiation elements 221 and 222 may be separated through at least one isolation wall 251, 252, and 253. By installing the isolation walls 251 and 252, the radiation elements 221 and 222 on the array antenna may increase directivity. The isolation walls 251, 252, and 253 may enable radio waves radiated through the radiation elements 221 and 222 to be radiated in an oriented direction without being dispersed. The isolation walls 251, 252, and 253 may be made of, for example, a material that may have a conductive property. According to various embodiments, the isolation walls 251, 252, and 253 may be, for example, a dielectric coated with a material that may have a conductive property.

The antenna unit 200 may include an antenna substrate 220 including at least one radiation element, a cover 210 separated by a predetermined distance or more from the antenna substrate 220, at least one radiation element 221 and 222 disposed toward the outside on the antenna substrate 220, repeating radiation elements 241 and 242 disposed to correspond to the radiation elements 221 and 222 in at least a portion of the cover 210, and at least one isolation wall 251, 252, and 253.

Each of the at least one radiation element 221 and 222 and at least one repeating radiation element 241 and 242 may be disposed to face each other. For example, the first radiation element 221 may be disposed to face the first repeating radiation element 241 on the cover 210.

At least one isolation wall 251, 252, and 253 may separate at least one respective radiation element 221 and 222 and separate the at least one respective repeating radiation element 241 and 242. For example, the first radiation element 221 and the first repeating radiation element 241 may be disposed between the first isolation wall 251 and the second isolation wall 252, and the first radiation element 221 and the first repeating radiation element 241 may be separated from the other radiation element 222 and the other repeating radiation element 242 by the first isolation wall 251 and the second isolation wall 252. In another example, the second radiation element 222 and the second repeating radiation element 242 may be disposed between the second isolation wall 252 and the third isolation wall 253, and the second radiation element 222 and the second repeating radiation element 242 may be separated from the other radiation element 221 and the other repeating radiation element 241 by the second isolation wall 252 and the third isolation wall 253. A length of the at least one isolation wall 251, 252, and 253 may be the same as a separation distance between the cover 210 and the antenna substrate 220.

Figure 11:
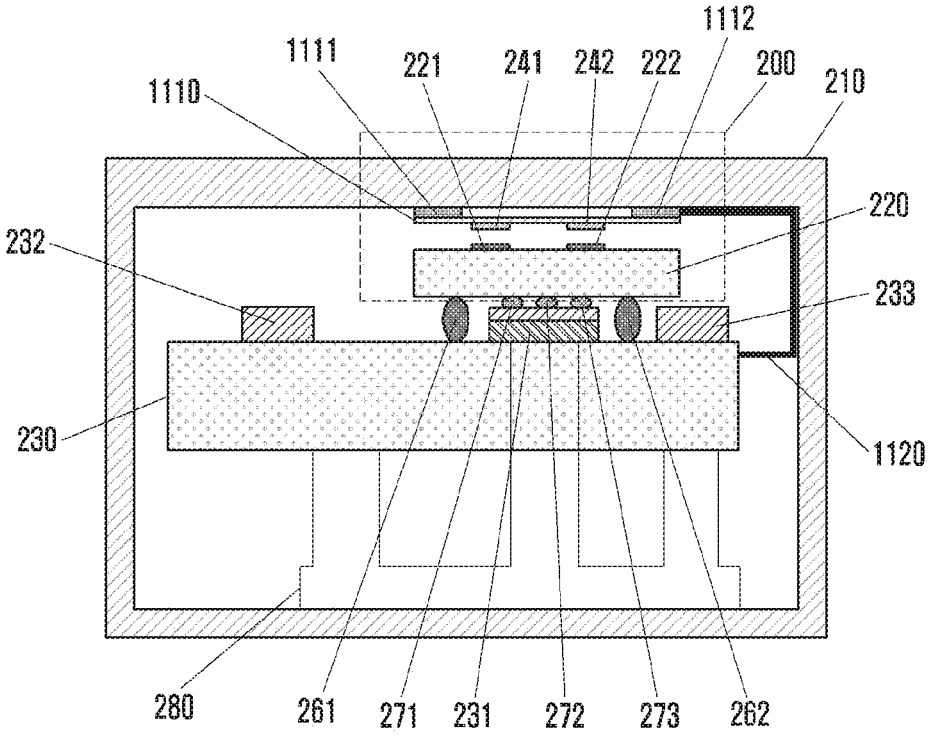
FIG. 11 is a diagram illustrating an antenna device according to various embodiments of the present invention.

FIG. 11 is a diagram illustrating an antenna device according to various embodiments of the present invention.

The antenna device may be a base station 110, CPE 120, or router 150.

The antenna device may include an antenna unit 200, cover 210, antenna substrate 220, main board 230, and heat sink 280.

At least one component 231, 232, and 233 may be included on the main board 230. At least one component 231, 232, and 233 may be an integrated circuit (IC), a semiconductor chip, and a radio frequency integrated circuit (RFIC) 231 disposed on the main board 230.

The RFIC 231 includes at least one connection means (e.g., ball grid array (BGA)) 271, 272, and 273, and the RFIC 231 may be electrically connected to the antenna substrate 220 using the at least one connection means 271, 272, and 273. The main board 230 may support the antenna substrate 220 and the antenna unit 200 through at least one support means 261 and 262.

The RFIC 231 may be disposed toward the main board 230 on the antenna substrate 220, and an array antenna including at least one radiation element 221 and 222 may be disposed toward the cover 210.

The cover 210 may include at least one repeating radiation element 241 and 242 disposed to correspond to the radiation elements 221 and 222 in at least a portion thereof. At least one radiation element 221 and 222 and at least one repeating radiation element 241 and 242 may be separated by a predetermined distance or more. At least one repeating radiation element 241 and 242 may include a resonance structure to be electromagnetically coupled to the at least one radiation element 221 and 222. At least one repeating radiation element 241 and 242 may form a resonance structure with the at least one radiation element 221 and 222 to radiate radio waves to the outside of the cover 210 by reducing attenuation of radio waves radiated from the at least one radiation element 221 and 222. Alternatively, at least one repeating radiation element 241 and 242 may transfer radio waves transferred from the outside through the cover 210 to the at least one radiation element 221 and 222 through resonance. According to various embodiments of the present invention, the cover 210 may be a dielectric such as a plastic.

In at least a portion of the cover 210, at least one piezoelectric actuator 1111 and 1112 may be disposed. A film 1110 may be attached to the at least one piezoelectric actuator 1111 and 1112.

The repeating radiation elements 241 and 242 may be disposed on the film 1110. An air gap between the repeating radiation elements 241 and 242 and the radiation elements 221 and 222 may be changed according to a length change of the piezoelectric actuators 1111 and 1112.

At least one piezoelectric actuator 1111 and 1112 may be electrically connected to the main board 230 using a conductor 1120, and a length of the piezoelectric actuators 1111 and 1112 may be changed under the control of the main board 230. The main board 230 may transfer an electrical stimulation to the piezoelectric actuator 1111 and 1112 through the conductor 1120; and the piezoelectric actuators 1111 and 1112, having received the electrical stimulation, may change a length thereof. The processor 232 included in the main board 230 may determine reception sensitivity or radiation sensitivity of radio waves to transfer an electrical signal that may change a length of the piezoelectric actuators 1111 and 1112 to the piezoelectric actuators 1111 and 1112 through the conductor 1120.

At least one radiation element 221 and 222 and at least one respective repeating radiation element 241 and 242 may be disposed to face each other. For example, the first radiation element 221 may be disposed to face the first repeating radiation element 241 on the cover 210.

An air gap of the at least one radiation element 221 and 222 and the at least one repeating radiation element 241 and 242 may be changed according to a length change of the piezoelectric actuators 1111 and 1112.

Figure 12A:
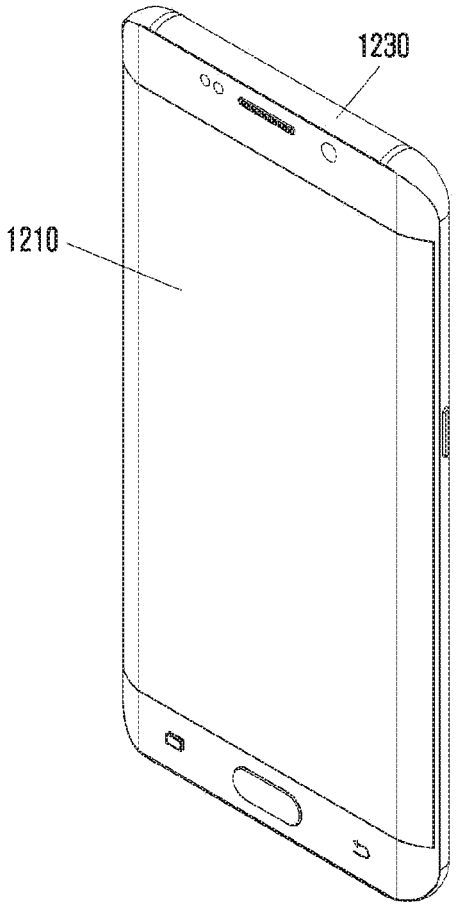
FIG. 12A is a front view illustrating a mobile terminal according to various embodiments of the present invention.

FIG. 12A is a front view illustrating a mobile terminal 130 according to various embodiments of the present invention.

Figure 12B:
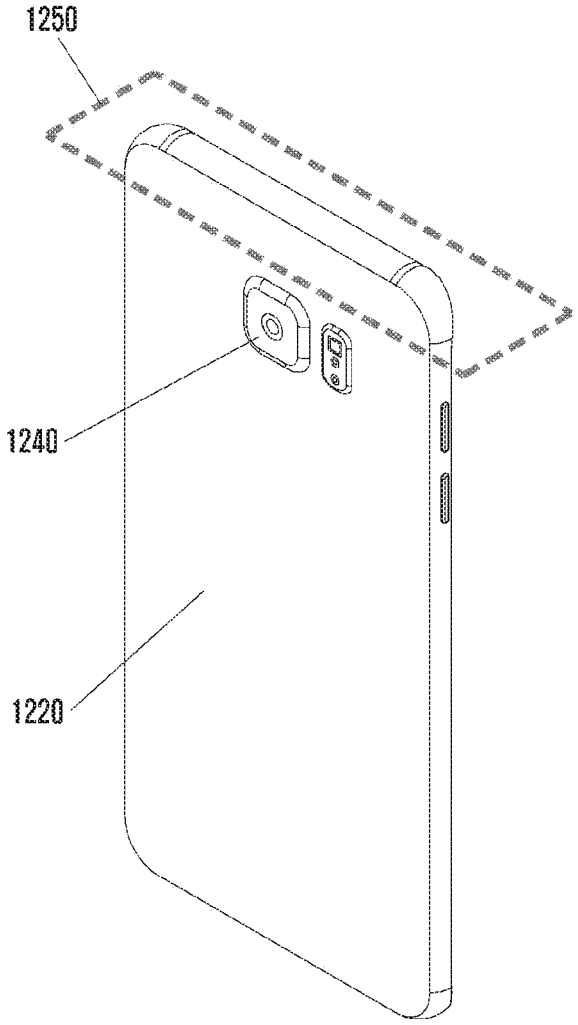
FIG. 12B is a rear view illustrating a mobile terminal according to various embodiments of the present invention.

FIG. 12B is a rear view illustrating a mobile terminal 130 according to various embodiments of the present invention.

With reference to FIGS. 12A and 12B, at a front surface of the mobile terminal 130, a display 1210 may be disposed. The display 1210 may further include a touch panel that may receive a touch input, and the display 1210 may be implemented into a touch screen. At a rear surface of the mobile terminal 130, a cover 1220 may be disposed, and in at least a portion of the rear surface of the mobile terminal 130, a camera 1240 may be exposed. An area in which the camera 1240 is disposed may be an upper end portion of the mobile terminal 130. The front surface and the rear surface of the mobile terminal 130 may be separated from each other to form a space, and a frame 1230 may enclose the space. The frame 1230 may enclose a space formed between the front surface and the rear surface of the mobile terminal 130. The cover 1220 and the frame 1230 may be made of a metal or a dielectric.

Figure 13:
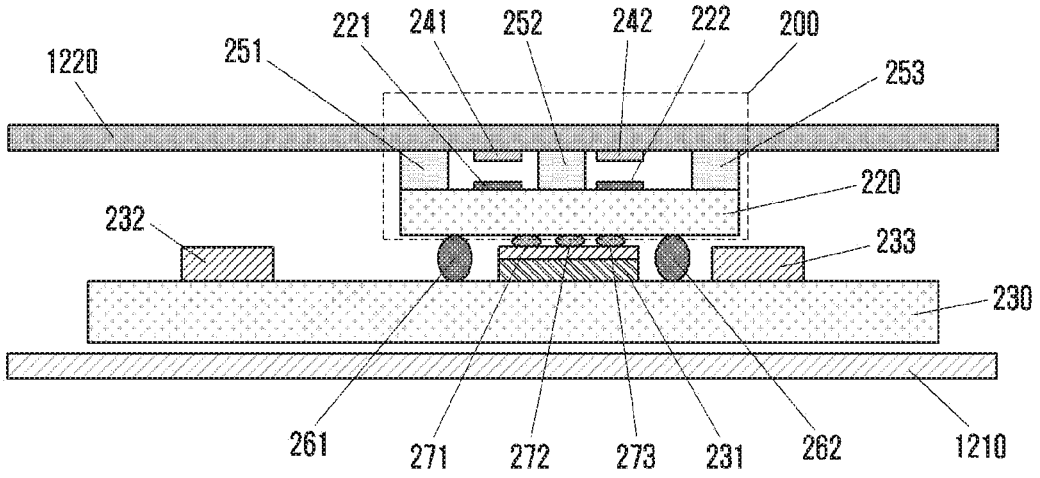
FIG. 13 is a cross-sectional view illustrating a mobile terminal according to various embodiments of the present invention.

FIG. 13 is a cross-sectional view illustrating a mobile terminal 130 according to various embodiments of the present invention.

With reference to FIGS. 12A, 12B, and 13, an electronic device such as the mobile terminal 130 may include an antenna unit 200, display 1210, cover 1220, antenna substrate 220, and main board 230.

The display 1210, the main board 230, the antenna substrate 220, and the cover 1220 may be disposed in order of the display 1210, the main board 230, the antenna substrate 220, and the cover 1220 based on the front surface of the mobile terminal 130.

At least one component 231, 232, and 233 may be included on the main board 230. The at least one component 231, 232, and 233 may be an integrated circuit (IC), a semiconductor chip, a radio frequency integrated circuit (RFIC) 231, and a processor 232 disposed on the main board 230. The processor 232 may control the RFIC 231 received from the RFIC 231 and control other electronic components according to reception sensitivity of radio waves.

The RFIC 231 may include at least one connection means (e.g., ball grid array (BGA)) 271, 272, and 273, and the RFIC 231 may be electrically connected to the antenna substrate 220 using at least connection means 271, 272, and 273. The main board 230 may support the antenna substrate 220 and the antenna unit 200 through the at least one support means 261 and 262.

The RFIC 231 may be disposed toward the main board 230 on the antenna substrate 220, and an array antenna including at least one radiation element 221 and 222 may be disposed toward the cover 1220.

The cover 1220 may include at least one repeating radiation element 241 and 242 disposed to correspond to the radiation elements 221 and 222 in at least a portion thereof. At least one radiation element 221 and 222 and at least one repeating radiation element 241 and 242 may be separated from each other by a predetermined distance or more. At least one repeating radiation element 241 and 242 may include a resonance structure to be electromagnetically coupled to at least one radiation element 221 and 222. At least one repeating radiation element 241 and 242 reduces attenuation of radio waves radiated from the at least one radiation element 221 and 222 by forming a resonance structure with the at least one radiation element 221 and 222 to radiate radio waves to the outside of the cover 1220. In contrast, at least one repeating radiation element 241 and 242 may transfer radio waves transferred from the outside through the cover 1220 to at least one radiation element 221 and 222 through resonance. According to various embodiments, the cover 1220 may be a dielectric such as a plastic. According to various embodiments, the cover 1220 may be an anodized metal. According to various embodiments, the cover 1220 may be a metal.

Each of the radiation elements 221 and 222 may be separated through at least one isolation wall 251, 252, and 253. By installing the isolation walls 251 and 252, the radiation elements 221 and 222 on the array antenna 221 and 222 may increase directivity. The isolation walls 251, 252, and 253 may enable radio waves radiated through the radiation elements 221 and 222 to be radiated in an oriented direction instead of being dispersed. The isolation walls 251, 252, and 253 may be made of, for example, a material that may have a conductive property. According to various embodiments, the isolation walls 251, 252, and 253 may be, for example, a dielectric coated with a material that may have a conductive property.

The antenna unit 200 may include an antenna substrate 220 including at least one radiation element, a cover 210 separated by a predetermined distance or more from the antenna substrate 220, at least one radiation element 221 and 222 disposed toward the outside on the antenna substrate 220, repeating radiation elements 241 and 242 disposed to correspond to the radiation elements 221 and 222 in at least a portion of the cover 210, and at least one isolation wall 251, 252, and 253.

Each of the at least one radiation element 221 and 222 and at least one repeating radiation element 241 and 242 may be disposed to face each other. For example, the first radiation element 221 may be disposed to face the first repeating radiation element 241 on the cover 1220.

At least one isolation wall 251, 252, and 253 may separate at least one respective radiation element 221 and 222 and separate at least one respective repeating radiation element 241 and 242. For example, the first radiation element 221 and the first repeating radiation element 241 may be disposed between the first isolation wall 251 and the second isolation wall 252, and the first radiation element 221 and the first repeating radiation element 241 may be separated from the other radiation element 222 and the other repeating radiation element 242 by the first isolation wall 251 and the second isolation wall 252. In another example, the second radiation element 222 and the second repeating radiation element 242 may be disposed between the second isolation wall 252 and the third isolation wall 253, and the second radiation element 222 and the second repeating radiation element 242 may be separated from the other radiation element 221 and the other repeating radiation element 241 by the second isolation wall 252 and the third isolation wall 253. A length of the at least one isolation wall 251, 252, and 253 may be the same as a separation distance between the cover 1220 and the antenna substrate 220.

Figure 14:
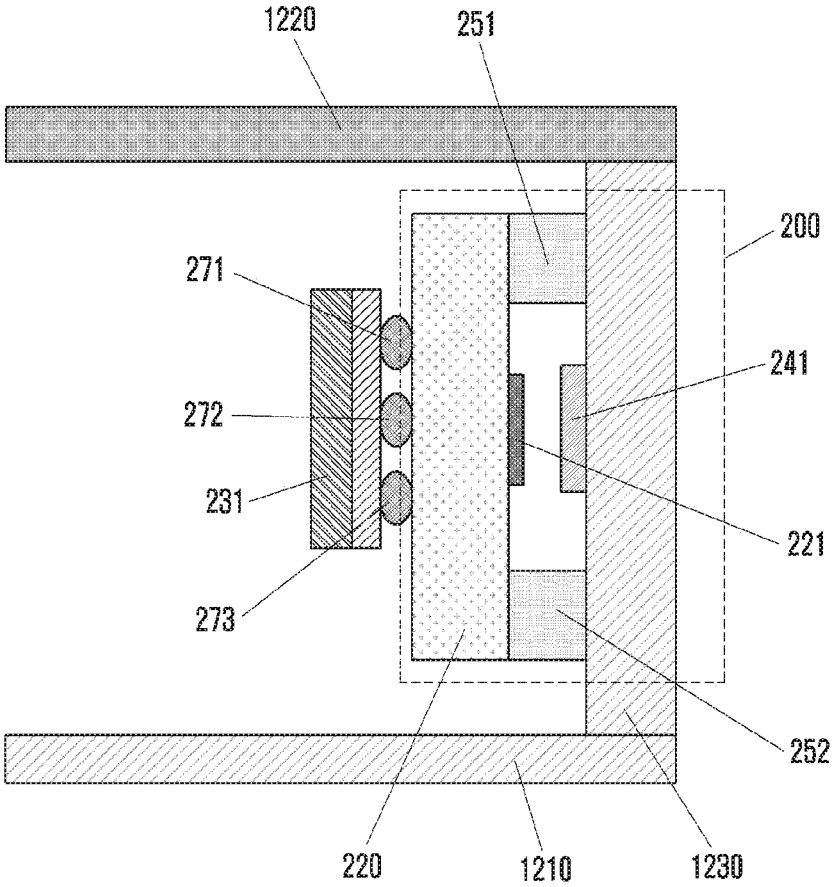
FIG. 14 is a cross-sectional view illustrating a mobile terminal according to various embodiments of the present invention.

FIG. 14 is a cross-sectional view illustrating a mobile terminal 130 according to various embodiments of the present invention.

With reference to FIGS. 12A, 12B and 13, an electronic device such as the mobile terminal 130 may include an antenna unit 200, display 1210, cover 1220, frame 1230, and antenna substrate 220. FIG. 14 is an embodiment of a case formed to include the frame 1230 in the antenna unit 200 and is a cross-sectional view of a region 1250 in FIG. 12B.

The antenna unit 200 may be disposed in a direction of the frame 1230 at a space between the display 1210 and the cover 1220 based on the front surface of the mobile terminal 130.

The RFIC 231 may include at least one connection means (e.g., ball grid array (BGA)) 271, 272, and 273, and the RFIC 231 may be electrically connected to the antenna substrate 220 using at least connection means 271, 272, and 273.

An array antenna including at least one radiation element 221 may be disposed toward the frame 1230.

The frame 1230 may include at least one repeating radiation element 241 disposed to correspond to the radiation element 221 in at least a portion thereof. At least one radiation element 221 and at least one repeating radiation element 241 may be separated from each other by a predetermined distance or more. At least one repeating radiation element 241 may include a resonance structure to be electromagnetically coupled to at least one radiation element 221. At least one repeating radiation element 241 reduces attenuation of radio waves radiated from the at least one radiation element 221 by forming a resonance structure with at least one radiation element 221 to radiate radio waves to the outside of the frame 1230. Alternatively, at least one repeating radiation element 241 may transfer radio waves transferred from the outside through the frame 1230 to at least one radiation element 221 through resonance. According to various embodiments, the frame 1230 may be a dielectric such as a plastic. According to various embodiments, the frame 1230 may be an anodized metal. According to various embodiments, the frame 1230 may be a metal.

Each of the radiation elements 221 may be separated through at least one isolation wall 251 and 252. By installing the isolation walls 251 and 252, the radiation element 221 on the array antenna may increase directivity. The isolation walls 251 and 252 may enable radio waves radiated through the radiation elements 221 and 222 to be radiated in an oriented direction instead of being dispersed. The isolation walls 251 and 252 may be made of, for example, a material that may have a conductive property. According to various embodiments, the isolation walls 251 and 252 may be, for example, a dielectric coated with a material that may have a conductive property.

The antenna unit 200 may include an antenna substrate 220 including at least one radiation element, a frame 1230 separated by a predetermined distance or more from the antenna substrate 220, at least one radiation element 221 disposed toward the outside on the antenna substrate 220, a repeating radiation element 241 disposed to correspond to the radiation element 221 in at least a portion of the frame 1230, and at least one isolation wall 251 and 252.

Each of at least one radiation element 221 and at least one repeating radiation element 241 may be disposed to face each other. For example, the first radiation element 221 may be disposed to face the first repeating radiation element 241 on the frame 1230.

At least one isolation wall 251 and 252 may separate at least one radiation element 221 and separate the at least one repeating radiation element 241. For example, the first radiation element 221 and the first repeating radiation element 241 may be disposed between the first isolation wall 251 and the second isolation wall 252, and the first radiation element 221 and the first repeating radiation element 241 may be separated from the other radiation element 222 and the other repeating radiation element 242 by the first isolation wall 251 and the second isolation wall 252. A length of the at least one isolation wall 251 and 252 may be the same as a separation distance between the frame 1230 and the antenna substrate 220.

Figure 15:
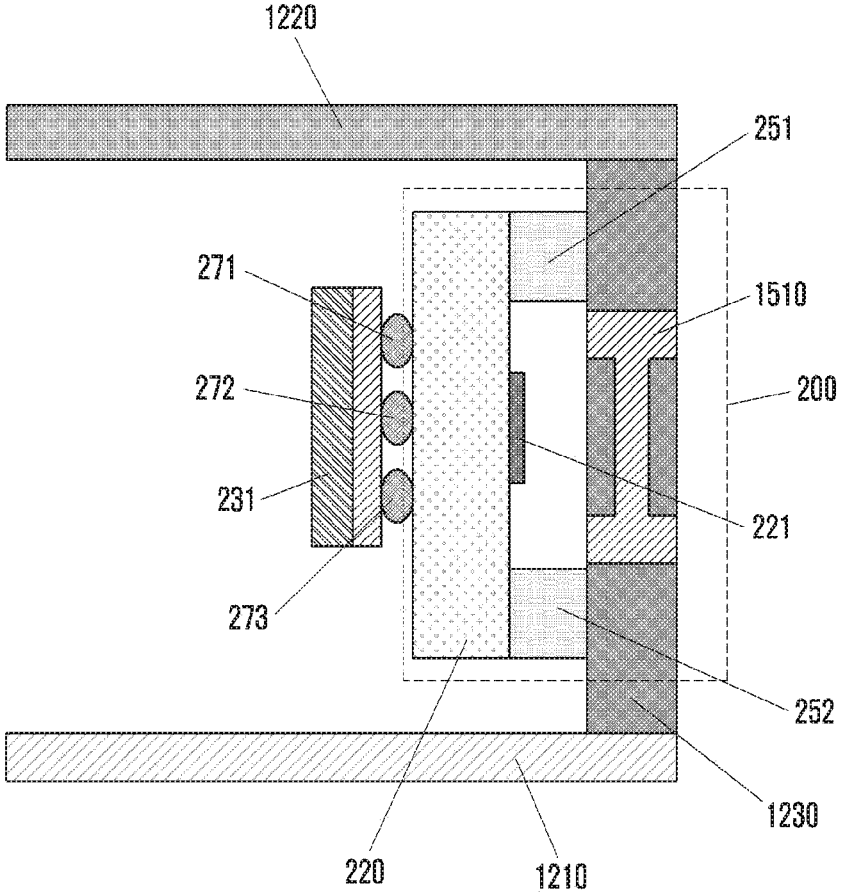
FIG. 15 is a cross-sectional view illustrating a mobile terminal according to various embodiments of the present invention.

FIG. 15 is a cross-sectional view illustrating a mobile terminal 130 according to various embodiments of the present invention.

With reference to FIGS. 12A, 12B, and 13, an electronic device such as the mobile terminal 130 may include an antenna unit 200, a display 1210, a cover 1220, a frame 1230, and an antenna substrate 220. FIG. 15 illustrates an example of a case formed to include the frame 1230 in the antenna unit 200 and is a cross-sectional view of a region 1250 in FIG. 12B.

The antenna unit 200 may be disposed in a direction of the frame 1230 in a space between the display 1210 and the cover 1220 based on a front surface of the mobile terminal 130.

An RFIC 231 includes at least one connection means (e.g., ball grid array (BGA)) 271, 272, and 273, and the RFIC 231 may be electrically connected to the antenna substrate 220 using at least one connection means 271, 272, and 273.

An array antenna including at least one radiation element 221 may be disposed toward the frame 1230.

In at least a portion of the frame 1230, at least one repeating radiation element 1510 disposed to correspond to the radiation element 221 may be included within the frame 1230. At least one radiation element 221 and at least one repeating radiation element 1510 may be separated by a predetermined distance or more. At least one repeating radiation element 1510 may include a resonance structure to be electromagnetically coupled to at least one radiation element 221. At least one repeating radiation element 1510 reduces attenuation of radio waves radiated from the at least one radiation element 221 by forming a resonance structure with at least one radiation element 221 to radiate radio waves to the outside of the frame 1230. Alternatively, at least one repeating radiation element 1510 may transfer radio waves transferred from the outside through the frame 1230 to at least one radiation element 221 through resonance. At least one repeating radiation element 1510 may include various metallic patterns. According to various embodiments, the frame 1230 may be a dielectric such as a plastic. According to various embodiments, the frame 1230 may be an anodized metal. According to various embodiments, the frame 1230 may be a metal.

Each of the radiation elements 221 may be separated through at least one isolation wall 251 and 252. By installing the isolation walls 251 and 252, the radiation element 221 on the array antenna may increase directivity. The isolation walls 251 and 252 may enable radio waves radiated through the radiation element 221 to be radiated in an oriented direction without being dispersed. The isolation walls 251 and 252 may be made of, for example, a material that may have a conductive property. According to various embodiments, the isolation walls 251 and 252 may be, for example, a dielectric coated with a material that may have a conductive property.

The antenna unit 200 may include an antenna substrate 220 including at least one radiation element, a frame 1230 separated by a predetermined distance or more from the antenna substrate 220, at least one radiation element 221 disposed toward the outside on the antenna substrate 220, a repeating radiation element 1510 disposed to correspond to the radiation element 221 at the inside of the frame, and at least one isolation wall 251 and 252.

Each of the at least one radiation element 221 and at least one repeating radiation element 1510 may be disposed to face each other.

At least one isolation wall 251 and 252 may separate at least one radiation element 221. For example, the first radiation element 221 may be disposed between the first isolation wall 251 and the second isolation wall 252, and the first radiation element 221 may be separated from the other radiation element by the first isolation wall 251 and the second isolation wall 252. A length of the at least one isolation wall 251 and 252 may be the same as a separation distance between the frame 1230 and the antenna substrate 220.

Figure 16A:
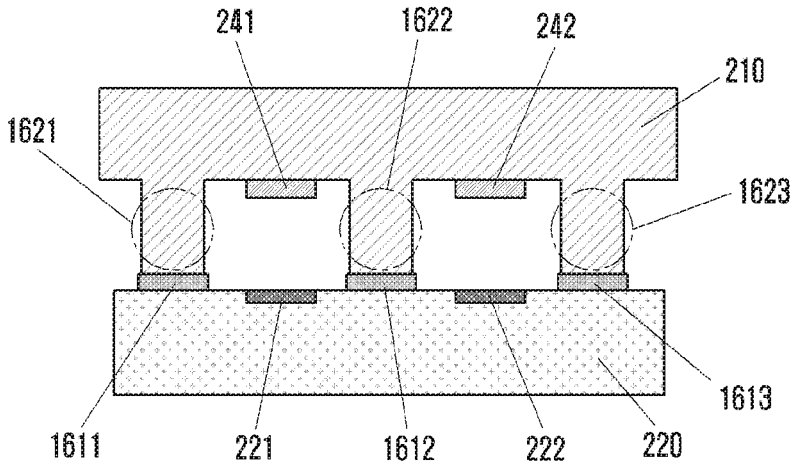
FIGS. 16A to 16C are diagrams illustrating a method of producing an antenna unit according to various embodiments of the present invention.
Figure 16B:
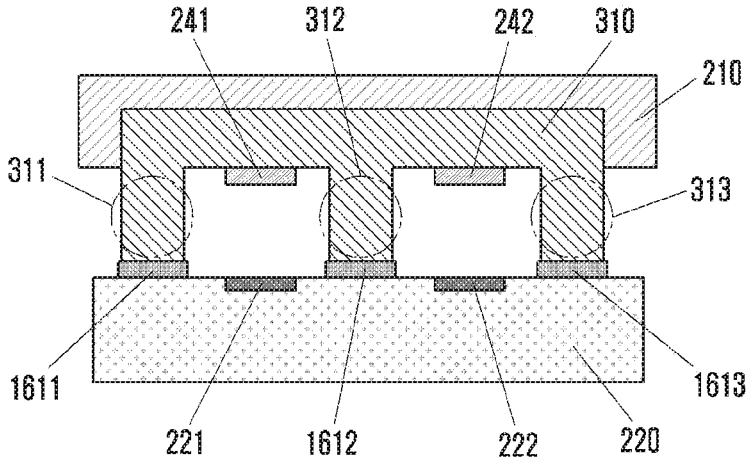
Figure 16C:
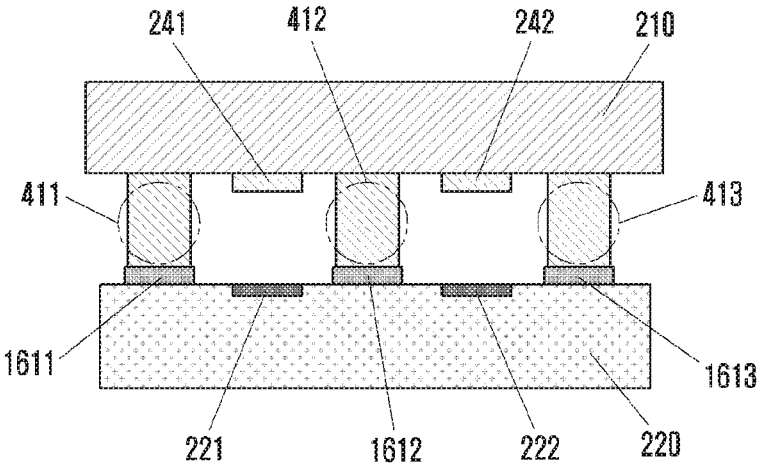

FIGS. 16A to 16C are diagrams illustrating a method of producing an antenna unit 200 according to various embodiments of the present invention.

In FIG. 16A, upon molding the cover 210, at least one protruding structure 1621, 1622, and 1623 may be molded together with the cover 210, and the cover 210 may use at least one protruding structure 1621, 1622, and 1623 as an isolation wall (e.g., 251, 252, and 253) for separating the radiation elements 221 and 222 of the array antenna. Each of the at least one protruding structure 1621, 1622, and 1623 may contact the antenna substrate 220 to separate each of the radiation elements 221 and 222 of the array antenna. When each of the at least one protruding structure 1621, 1622, and 1623 is coupled to the antenna substrate 220, at least one rubber component 1611, 1612, and 1613 may be disposed between the at least one protruding structure 1621, 1622, and 1623 and the antenna substrate 220. At least one rubber component 1611, 1612, and 1613 can improve a bonding force between the at least one protruding structure 1621, 1622, and 1623 and the antenna substrate 220.

In FIG. 16B, the first cover 210 may be coupled to the second cover 310, and upon molding the second cover 310, at least one protruding structure 311, 312, and 313 may be molded together with the second cover 310 and the second cover 310 may use at least one protruding structure 311, 312, and 313 as an isolation wall (e.g., 251, 252, and 253) for separating the radiation elements 221 and 222 of the array antenna. Each of the at least one protruding structure 311, 312, and 313 may contact the antenna substrate 220 to separate each of the radiation elements 221 and 222 of the array antenna. When each of at least one protruding structure 311, 312, and 313 is coupled to the antenna substrate 220, at least one rubber component 1611, 1612, and 1613 may be disposed between at least one protruding structure 311, 312, and 313 and the antenna substrate 220. At least one rubber component 1611, 1612, and 1613 can improve a bonding force between the at least one protruding structure 311, 312, and 313 and the antenna substrate 220.

In FIG. 16C, the cover 210 may be coupled to at least one separately formed protruding structure 411, 412, and 413 and may use at least one protruding structure 411, 412, and 413 as an isolation wall (e.g., 251, 252, and 253) for separating radiation elements 221 and 222 of the array antenna. Each of the at least one protruding structure 411, 412, and 413 may contact the antenna substrate 220 to separate each of the radiation elements 221 and 222 of the array antenna. When each of at least one protruding structure 411, 412, and 413 is coupled to the antenna substrate 220, at least one rubber component 1611, 1612, and 1613 may be disposed between at least one protruding structure 411, 412, and 413 and the antenna substrate 220. At least one rubber component 1611, 1612, and 1613 can improve a bonding force between the at least one protruding structure 411, 412, and 413 and the antenna substrate 220.

The term "module" used in this document includes a unit configured with hardware, software, or firmware and may be interchangeably used with a term such as a logic, logic block, component, or circuit. The "module" may be an integrally configured component, a minimum unit that performs at least one function, or a portion thereof. The "module" may be implemented mechanically or electronically and may include, for example, an application-specific integrated circuit (ASIC) chip, field-programmable gate arrays (FPGAs), and a programmable logic device, which are known or to be developed in the future, that perform some operations. At least a portion of a device (e.g., modules or functions thereof) or a method (e.g., operations) according to various embodiments may be implemented with an instruction stored at a computer readable storage medium (e.g., memory (830)) in a form of a program module. When the instruction is executed by a processor (e.g., processor (820)), the processor may perform a function corresponding to the instruction. The computer readable recording medium may include a hard disk, floppy disk, magnetic medium (e.g., magnetic tape), optical recording medium (e.g., compact disc read-only memory (CD-ROM), digital video disc (DVD)), magnetic-optical medium (e.g., floptical disk), and internal memory. The instruction may include a code made by a compiler or a code that may be executed by an interpreter. A module or a programming module according to various embodiments may include at least one of the foregoing elements, may omit some elements, or may further include another element. According to various embodiments, operations performed by a module, a program module, or another constituent element may be sequentially, parallelly, repeatedly, or heuristically executed, at least some operations may be executed in a different order or omitted, or another operation may be added.

The invention claimed is:

1. An electronic device, comprising:

a display forming a first surface;

a cover forming a second surface;

a frame enclosing a space formed between the first surface and the second surface;

a main board disposed between the display and the cover, wherein a first side of the main board is disposed to face the display and a second side of the main board opposite to the first side of the main board is disposed to face the cover;

an array antenna comprising at least one radiation element;

an antenna substrate having a first side on which the array antenna is disposed; and a radio frequency integrated circuit (RFIC) coupled to a second side of the antenna substrate opposite to the first side of the antenna substrate, wherein the first side of the antenna substrate is disposed to face a side of the frame, and wherein the frame is separated by a predetermined distance from the antenna substrate and comprises at least one repeating radiation element corresponding to the at least one radiation element.

2. The electronic device of claim 1, wherein the frame comprises a metal frame and a dielectric, and wherein the at least one repeating radiation element is disposed on the metal frame.

3. The electronic device of claim 1, wherein the at least one repeating radiation element forms resonance with the at least one radiation element.

4. The electronic device of claim 1, wherein each of the at least one repeating radiation element is disposed to face a corresponding radiation element of the at least one radiation element.

5. The electronic device of claim 1, wherein the RFIC is coupled to the second side of the antenna substrate via a grid array.

6. The electronic device of claim 5, wherein in at least a portion of the frame, a ferroelectric is disposed, and at least one repeating radiation element is disposed on the ferroelectric, and wherein the electronic device further comprises a processor configured to generate a signal for controlling a dielectric constant of the ferroelectric according to propagation sensitivity and is electrically connected to the ferroelectric.

7. The electronic device of claim 5, wherein in at least a portion of the frame, at least one piezoelectric actuator is disposed, wherein the at least one piezoelectric actuator is coupled to a film, and at least one repeating radiation element is disposed on the film, and wherein the electronic device further comprises a processor configured to generate a signal for controlling a length of the piezoelectric actuator according to propagation sensitivity and is electrically connected to the piezoelectric actuator.

8. The electronic device of claim 1, further comprising at least one conductive pattern disposed between the at least one radiation element.

9. The electronic device of claim 1, further comprising at least one isolation wall having a length corresponding to a separation distance between the cove frame and the antenna substrate.

10. The electronic device of claim 9, wherein the at least one isolation wall separates each of the at least one radiation element.

11. The electronic device of claim 10, wherein the at least one isolation wall is made of a conductive material.

12. The electronic device of claim 10, wherein the at least one isolation wall is made of a dielectric material, and a conductive material is coated on the dielectric material.

13. The electronic device of claim 9, wherein the at least one isolation wall is together molded upon molding the frame.

14. The electronic device of claim 9, wherein the at least one isolation wall is molded together upon molding an additional cover, and the frame and the additional cover are coupled.

15. The electronic device of claim 9, wherein the at least one isolation wall is molded separately from the cover to be coupled to the frame.

* * * * *